US006135419A

United States Patent [19]

Hutson, Jr. et al.

[11] Patent Number: 6,135,419

[45] Date of Patent: Oct. 24, 2000

[54] COLUMN REPAIR JACK

[75] Inventors: Mat O. Hutson, Jr., 6513 W. 64th St., Chicago, Ill. 60638; Wayne Hunnicutt, Big Bend, Wis.

[73] Assignee: Mat O. Hutson, Jr., Chicago, Ill.

[21] Appl. No.: 09/103,387

[22] Filed: Jun. 24, 1998

[51] Int. Cl.[7] ..... B66F 3/24

[52] U.S. Cl. ..... 254/2 R; 254/133 R; 254/134

[58] Field of Search ..... 254/133 A, 133 R, 254/134, 100, 2 B, 2 R, DIG. 1, DIG. 4; 144/34.1, 34.2

[56] References Cited

U.S. PATENT DOCUMENTS

| | | | |
|---|---|---|---|
| 2,400,708 | 5/1946 | Parker et al. | 269/93 |
| 4,148,462 | 4/1979 | Jessup | 254/133 R |
| 4,486,004 | 12/1984 | Drewitz et al. | 254/2 B |
| 4,564,173 | 1/1986 | Atherton et al. | 254/133 R |
| 4,583,712 | 4/1986 | Wilks | 254/133 A |
| 5,622,354 | 4/1997 | Chagnot | 254/133 A |

*Primary Examiner*—Robert C. Watson
*Attorney, Agent, or Firm*—Factor & Partners, LLC

[57] ABSTRACT

A column repair jack, for repairing a column comprises a base, a lift member, an extending member, a releasable engaging member, a lift actuating member and a positioning member. The lift member is associated with the base member. The extending member includes a first end and a second end. The first end is associated with the lift member. The releasably engaging member, which is associated with the second end of the extending member, is capable of releasably engaging the column to be repaired. The positioning member positions at least a portion of the extending member at an angle relative to the column to be repaired. After attachment to a column, the lift actuating member facilitates the transfer of at least a portion of the load from the column to the column repair jack, to, in turn, facilitate repair of the column. The invention further comprises a method for attaching a column repair jack to a column to be repaired, for the repair of same.

10 Claims, 3 Drawing Sheets

COLUMN REPAIR JACK

BACKGROUND OF THE INVENTION

1. Field of the Invention

The present invention relates in general to a column repair jack, and more particularly to an apparatus and a method for repairing columns, which facilitates the repair and/or replacement of columns of a warehousing pallet shelving assembly.

2. Background Art

The use of pallet shelving systems in warehouses and other storage facilities has long been known in the art. Generally, these shelving systems comprise a series of vertical columns which together hold a series of shelves. Occasionally, the vertical columns can be damaged by excessive loads, mispositioned loads, and dropped loads, as well as accidents with vehicles such as fork lifts. When damaged, the vertical columns can either be replaced or repaired.

Replacement of the vertical columns is generally a laborious and time consuming activity. In particular, the replacement of a vertical column generally requires the removal of the goods stored on the shelves and disassembly of all of the shelves from the vertical column before the column can be removed. Inasmuch as the columns are often over 25 feet long, and support many shelves and, in turn, many goods, such a replacement procedure is substantially time consuming and disruptive. In addition, it is also expensive and wasteful to replace the vertical columns, not only because of the considerable time expended, but also due to the fact that the entire column is replaced even though the damaged region is often rather small, many times less than a couple of feet.

The columns can likewise be repaired through a splicing or a sleeving operation. More specifically, to repair a column, a fork lift is positioned near the column and is used to support one of the shelving units. In this manner, the fork lift can take the load off of the column and onto itself. Once the load has been transferred, the damaged portion of the column can be cut with a saw or with a welding torch, and a new section, in the form of a splice or a sleeve, can be inserted and welded to the existing cut. Once complete, the fork lift can be taken away and the load is returned to the newly repaired column. This repair method likewise has drawbacks. First, the fork lift is difficult to position properly, and, as a result the fork lift can damage the shelf upon which it is positioned. In addition, due to the magnitude of the load, it is likewise possible to tip over the fork lift after the fork lift assumes the full load from the vertical column, which may buckle certain shelves and cause loads to fall off of these shelves. Moreover, even if no problems are experienced, this method of repair is nevertheless exceedingly time consuming.

SUMMARY OF THE INVENTION

The invention comprises a column repair jack and associated method for attaching a column repair jack to a column to be repaired. The column repair jack includes a base, a lift member, an extending member, means for releasably engaging the column, means for actuating the lift member, and means for positioning the extending member at a desired acute angle relative to the column to be repaired. The base is positionable on a surface. The lift member is associated with the base. The extending member includes a first end and a second end. The first end is associated with the lift member and the second end is associated with the releasable engaging means. The actuating means actuates the lift member after attachment to the column. The load on the column is then at least partially transferred to the column repair jack, which then facilitates repair of the column.

In a preferred embodiment, the column repair jack further includes means for positioning the base in a desired orientation. In such an embodiment, the positioning means comprises one wheel associated with the base and means for manipulating the base to transfer a portion of the weight of the base to the wheel. Preferably, the manipulating means comprises a positioning stake associated with the base. The positioning stake cooperates with the extending member, wherein pivoting of the extending member pivots the base onto the wheel.

Preferably, the extending member comprises a plurality of releasably attachable tube members. The tube members are selectively attachable to render an extending member of a desired length. Preferably, each extending member is of a different length.

In another preferred embodiment, the base member includes a top surface which is at an acute angle relative to the column to be repaired, to facilitate the positioning of the lift member, and the extending member at an acute angle.

Preferably, the base includes a bottom surface which includes a non-skid surface.

In a preferred embodiment, the releasable engaging means comprises a column bracket configured to matingly engage a column to be repaired and means for releasably locking the column bracket in mating engagement with the column to be repaired. Preferably, the releasable locking means comprises a pin member. The pin member is configured to extend through at least one opening in the column bracket and a corresponding opening in a column to be repaired, to, in turn, maintain the column bracket in mating engagement with the column to be repaired.

Preferably, the column bracket comprises a center plate and perpendicular side plates. Together, these define a cavity corresponding to the configuration of the column to be repaired. The side plates include two opposing openings, wherein these openings corresponding to at least one pair of openings on the column to be repaired.

The method for attaching the column repair jack to a column includes the following steps: (a) positioning a base of the column repair jack proximate the column to be repaired; (b) attaching the first end of the extending member to the lift member; (c) positioning at least a portion of the extending member at an acute angle relative to the column to be repaired; (d) releasably engaging the second end of the extending member with the column; and (e) actuating the lift member to transfer at least a portion of the weight from the column to the column repair jack.

In a preferred embodiment, the step of positioning the base member may comprise the steps of: (a) engaging the extending member with a positioning stake; (b) manipulating the extending member so as to pivot the base member onto the wheel; and (c) directing the movement of the base on the wheel with the extending member.

In another preferred embodiment, the step of releasably engaging the second end of the extending member to the column to be repaired includes the steps of: (a) attaching a column bracket to the extending member; (b) matingly engaging the column bracket to the column to be repaired; and (c) releasably locking the column bracket to the column to be repaired.

Preferably, the step of releasably locking the column bracket to the column to be repaired comprises the step of extending a pin member through an opening in the column bracket and through a corresponding opening in the column.

DETAILED DESCRIPTION OF THE DRAWINGS

Figure 1A:
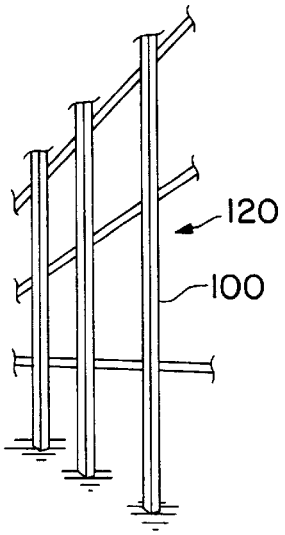
FIG. 1A of the drawings is a perspective view of a shelving system, showing in particular a damaged column.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment so illustrated.

Figure 1B:
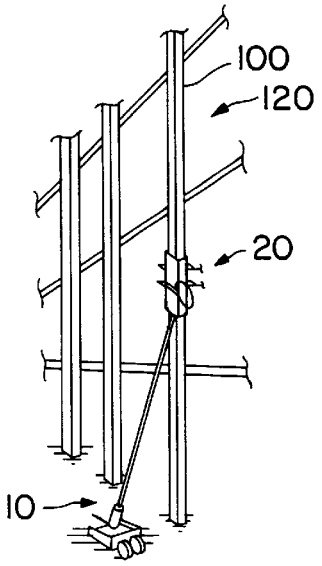
FIG. 1B of the drawings is a perspective view of the damaged column, showing in particular the attachment of the column repair jack of the present invention and the removal of the damaged portion.
Figure 1C:
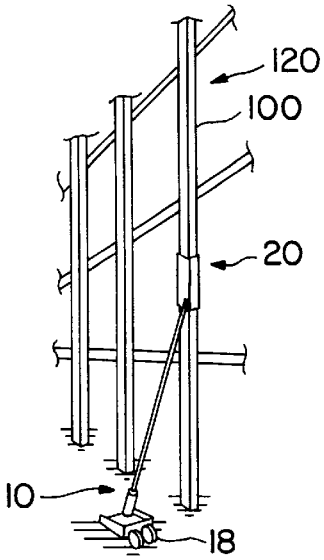
FIG. 1C of the drawings is a perspective view of the present invention, showing in particular the column after repair.
Figure 2:
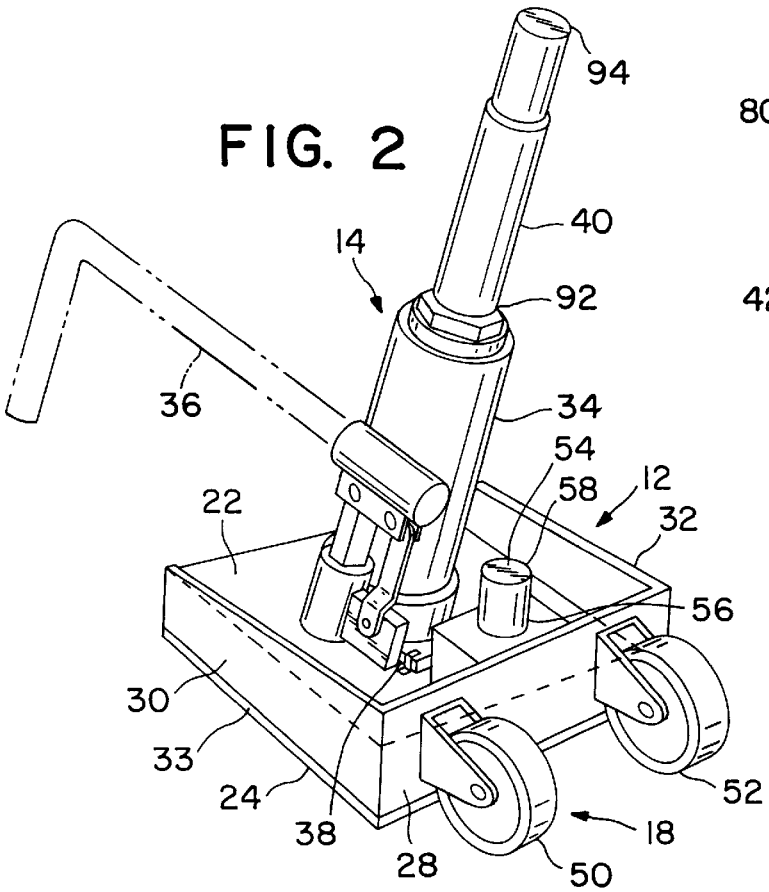
FIG. 2 of the drawings is a perspective view of a portion of the present invention.
Figure 4:
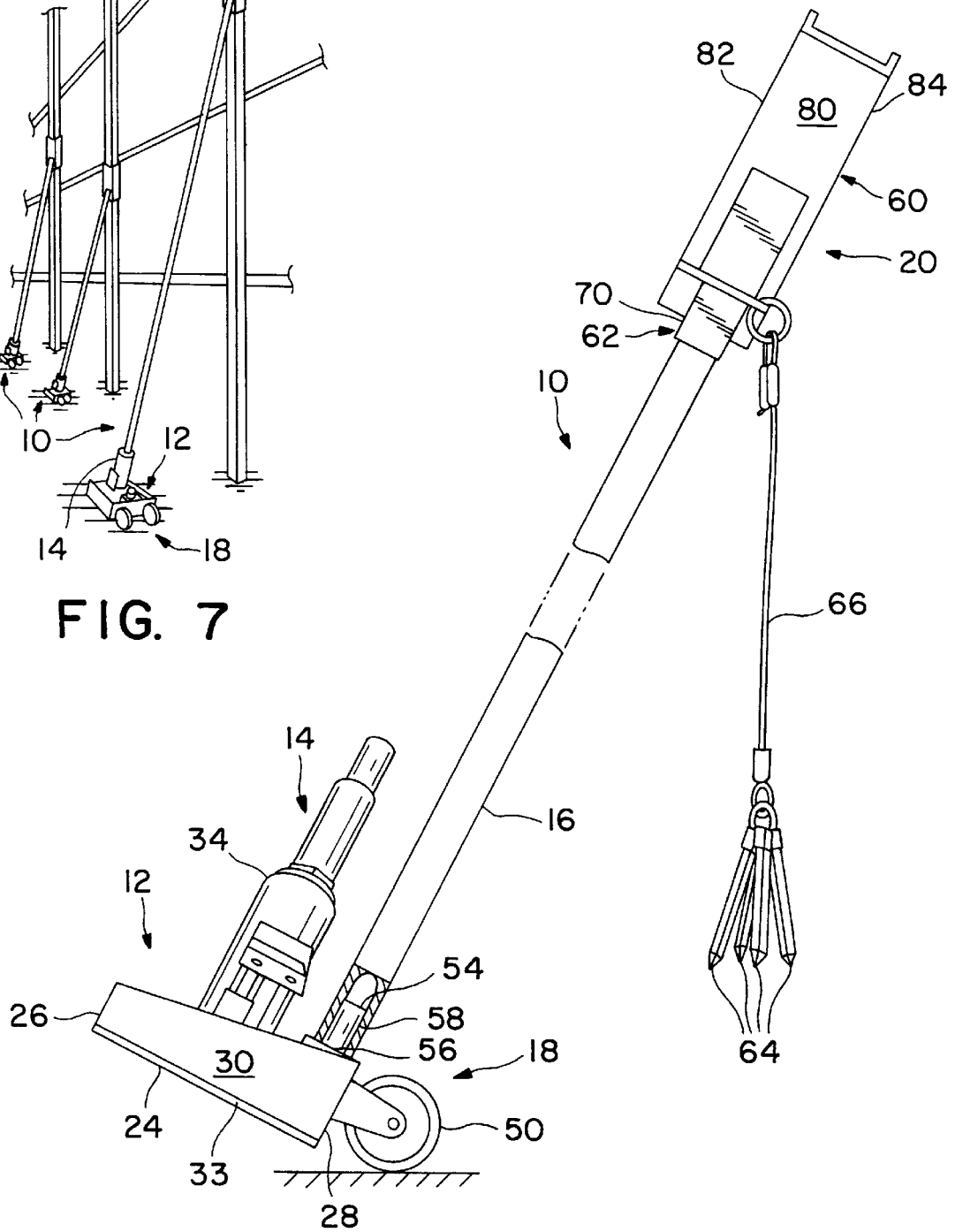
FIG. 4 of the drawings is a side elevational view of the invention.
Figure 5:
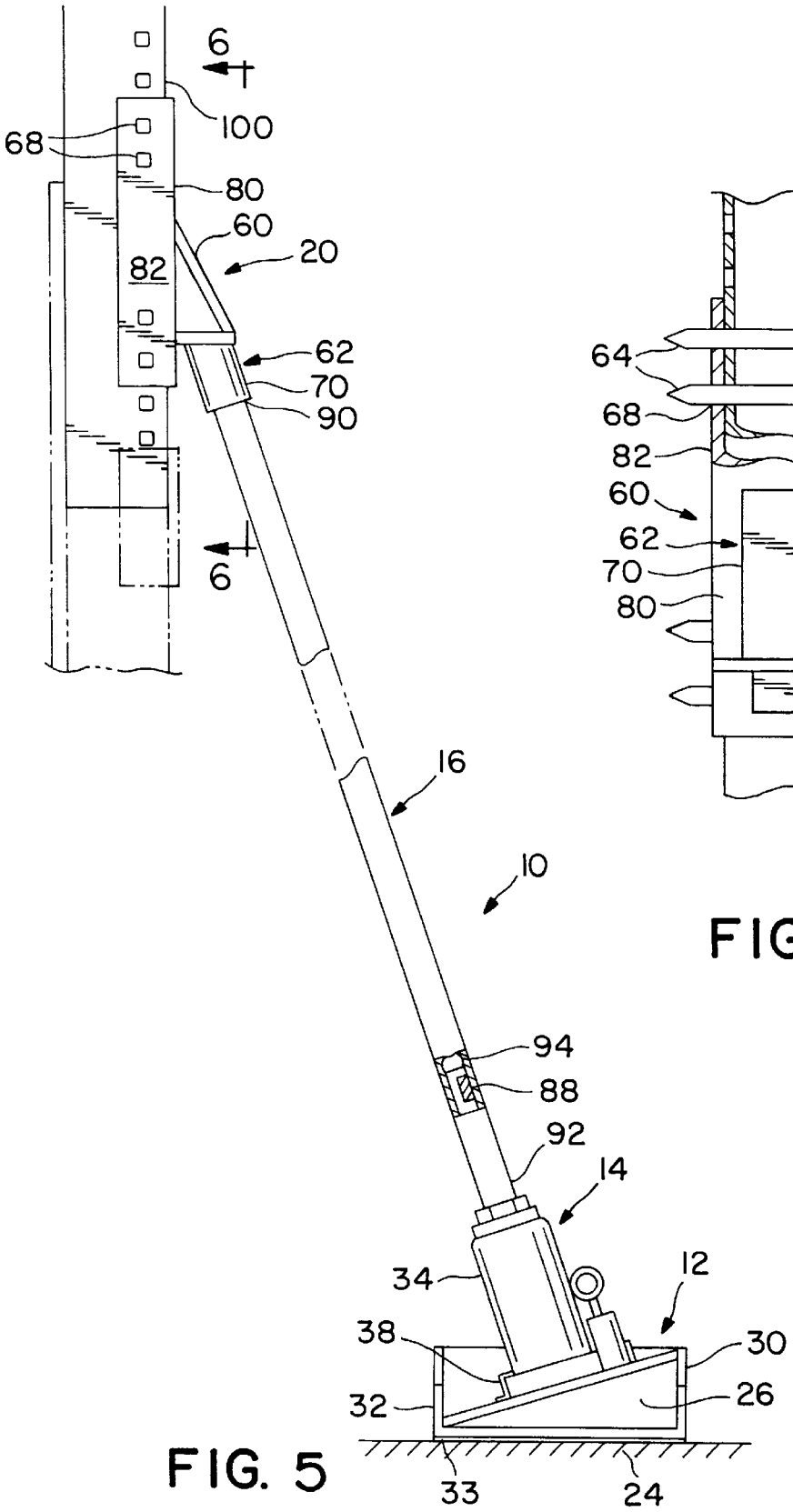
FIG. 5 of the drawings is a front plan view of the invention in operation, as shown in FIG. 2.

Column repair jack 10 is shown in FIGS. 4 and 5 as comprising base 12, lift member 14, extending members 16, means 18 for positioning the column repair jack in the desired orientation and means 20 for engaging an existing column 100 (FIGS. 1A–1C) of shelving unit 120 (FIGS. 1A–1C). Base 12, as shown in FIG. 2, includes top surface 22, bottom surface 24, front surface 26 (FIGS. 4 and 5), rear surface 28, and side surfaces 30 and 32. Top surface 21 is inclined relative to bottom surface 22 at an acute angle. Preferably, the angle is between 5° and 45°, and, most preferably less than 30°. As will be explained, such an angle positions the lift so that it is actuatable in the desired angular orientation relative to the ground and the vertical column. Bottom surface 24 further includes non-slip surface 33, which prevents inadvertent movement of the base relative to an underlying floor surface. The base is of a material suitable for supporting the weight that would otherwise be carried by the column that is to be repaired. For example, the surfaces comprise metal plates of varying thickness that are welded together. Of course, other base structures are likewise contemplated, such as, for example a cast base member or other unitary structure.

Lift member 14 is shown in FIGS. 2, 4 and 5 as comprising jack member 34, handle member 36 (FIG. 2) and means 38 for attaching the lift member to base 12 (FIGS. 2 and 5). Jack member 34 comprises a conventional hydraulic jack, having a desired capacity, such as 8 tons, which is controlled through movement of handle member 36. Of course, many types of jacks having any number of requisite capacities are contemplated for use, including scissor type jacks, mechanical gear driven jacks, lever jacks, among others. Lift attachment means 38 comprises a series of clamps which are associated with top surface 22 of base 12 and releasably attach the jack to top surface 22 of base 12. The lift attachment means may likewise comprise other fasteners, including nut and bolt fasteners, hook and loop fasteners, spring actuated fasteners, as well as both permanent and temporary adhesive. In addition, the jack may be welded to the base member.

Figure 3:
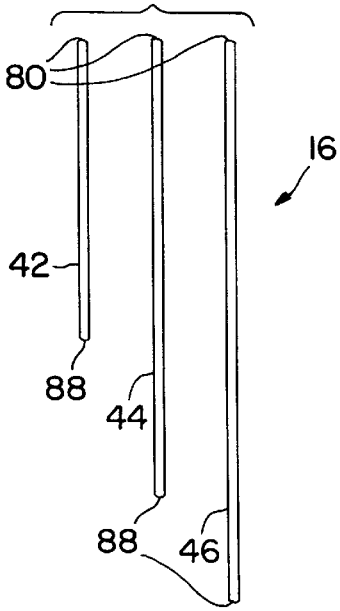
FIG. 3 of the drawings is a front plan view of three different tubes of the extending member.

Extending members 16 are shown in FIG. 3 as comprising adapter 40 (FIGS. 2, 4 and 5) and tubes 42, 44 and 46 (although tubes are referenced, it will be readily understood to those having ordinary skill in the art that any conventional structures having various cross-sectional configurations can be employed). Adapter 40 (FIG. 4) includes a first end 92 for mating engagement with the lift member, and second end 94 for mating engagement with the tubes. Each tube 42, 44 and 46 includes a first end, such as first end 88, and a second end, such as second end 90. The first end is configured so as to be capable of matingly engaging the second end of the adapter as well as the second end of any one of the other tubes. In addition, each of the tubes 42, 44 and 46 may be of any number of lengths, and, as such, the tubes may be attached to render an extending member of virtually any desired length. For example, and, by no means limited hereto, one set of tubes may comprise one or more five foot tubes, one or more seven foot tubes and one or more foot and a half tubes. Of course, it will be understood that any number of tubes in varying lengths are contemplated for use.

Positioning means 18 is shown in FIGS. 2 and 4 as comprising wheels 50 and 52 and positioning stake 54. Wheels 50 and 52 are positioned on rear surface 28, and comprise conventional self-contained wheel, axle and frame assemblies. While two wheels are shown, it is likewise contemplated that multiple wheel assemblies as well as a single large assembly may be employed. In addition, other means of facilitating movement on another surface, such as tracks, skids and low friction bearing surfaces are contemplated for use.

Positioning stake 54 is shown in FIGS. 2 and 4 as including first end 56 and second end 58. First end 56 is operably attached to top surface 22 of base 12, through for instance a weld, a fastener and/or an adhesive. Second end 58 is configured to receive any one of the first ends of tubes 42, 44 and 46. As will be explained, through cooperation of one of the tubes with the positioning stake, base 12 can be manipulated so that it is pivoted to be supported by wheels 50 and 52, at which time, column repair jack 10 can be easily moved to the desired location (See FIG. 4).

Figure 6:
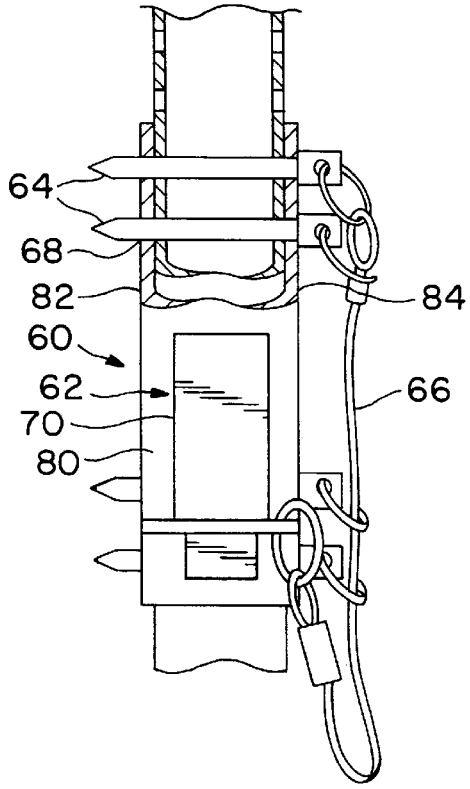
FIG. 6 of the drawings is a partial cross-sectional view taken generally at lines 6—6 of FIG. 3.

Engaging means 20 is shown in FIGS. 4–6 as comprising column bracket 60, receiving means 62, pins, such as pin 64 (FIGS. 4 and 6) and cable 66 (FIGS. 4 and 6). As shown in FIG. 6, column bracket 60 generally comprises a c-channel beam portion including center plate 80, two parallel side plates 82 and 84, and openings, such as openings 68. The side plates are generally perpendicular to center plate 80. The openings are positioned in a pattern identical to openings that are found on conventional column 100. Of course, inasmuch as several conventional rack columns exist, the width and length of the column bracket, as well as the orientation of the openings extending through portions of the channel are dictated by the particular configuration of the columns.

As shown in FIG. 6, pin 64 is configured to extend through an opening in the column bracket, through the cavity of the c-channel which contains the column and through an opening on the other side. As will be explained, the pin serves as a means for locking the column bracket to the column. Cable 66, as shown in FIGS. 4 and 6, attaches to the column bracket and to each of the pins, to prevent inadvertent loss of any of the pins during use and positioning. Of course, other means for locking the column bracket in operable engagement are likewise contemplated, such as for example, fasteners, hooks, clamps and other latches that engage existing structures, as well as specialized structures on the column.

Receiving means 62, as shown in FIGS. 4–6, comprises accepting member 70 positioned on column bracket 60. Accepting member 70 is configured to receive second end 90 of any of tube members 42, 44 and 46. In addition, where the column is substantially vertical and the surface of the ground is substantially horizontal, the accepting member may be configured so that the angle between the column bracket and the accepting member is substantially equal to the angle between the top surface and the bottom surface of the base (or 90° minus the angle of actuation of the lift member). Such an angular relationship further facilitates full engagement of bottom surface 24 of base 12 with the outside surface, along with full engagement of column bracket 60 with the column.

In operation, as shown in FIGS. 1A–1C, 5 and 6, it is first necessary to locate the damaged portion of the column. Generally, column repair jack 10 can be employed without removing any of the goods positioned on the shelves supported by the damaged column. However, where the goods are exceedingly heavy, or hazardous, it may be advantageous to remove the goods prior to commencing with the repair. Once located, one or more of tubes 42, 44 and 46 is/are attached to positioning stake 54 of positioning means 18. Next, as shown in FIG. 4, the base member is manipulated through movement of the tube member attached to the positioning stake until rotation of the base leads to engagement of wheel members 50 and 52 with the ground.

Once supported by the wheel members, column repair jack 10 can be positioned proximate the damaged column. In particular, as shown in FIGS. 1B and 5, the base is positioned so that jack 34 is angled directly at the front surface of the column to be repaired. This positioning is merely primary, and the position of base 12, and in turn, jack 34 may be fine-tuned after attachment of the tubes. As will be understood, the operator will achieve a certain feel with respect to the positioning of the base member after repeated use of the column repair jack and, as such, the operator will be able to position the column repair jack with very little fine adjustment.

Once preliminary positioned, as shown in FIGS. 1B and 5, all tubes are disconnected from positioning stake 54 and tubes 42, 44 and 46 are attached to each other as needed to render extending member 16 which is greater in length than the vertical distance of the damaged portion of the column. While the particular distance is not crucial, it is necessary to attach the column bracket some distance above the damaged portion of the column. Once the extending member is assembled, receiving means 62 is attached to second end 90 of the last tube member of extending member 16. Similarly, adapter 40 is attached to jack 34, and first end 88 of the first tube member of extending member is attached to adapter 40. The column repair jack has now been assembled and is ready for use.

To use the column repair jack, base 12 is slightly readjusted in its position (if needed) so that the column bracket can matingly engage the column to be repaired at a predetermined distance above the damaged area. Once matingly engaged, the height of column bracket 60 can be fine-tuned through the slight raising and/or lowering of jack 34, until openings 68 of column bracket 60 can align with similarly situated openings on the column. As shown in FIGS. 5 and 6, once aligned, pins 64 are slid through both the column bracket and the column to lock same in a mating engagement.

Once the pins lock the column bracket to the column, the jack is actuated to lift the column, which in turn, transfers the load from the column to the column repair jack. This partial load prior to repairing the column serves multiple purposes. For instance, it redistributes the load prior to cutting the column, which results in a safer operation. In addition, the partial load removes any slack that may be in the extending member and in the column bracket and pins so that the load can be uniformly fully transferred when the column is cut for repairs, which prevents further damage to the column and any shelves.

Next, as shown in FIGS. 1B and 1C, the beam may be cut and spliced, or a sleeve may be welded to the existing structure. It will be understood that the invention is not limited to any specific type of repair to a damaged column member nor to any specific range or type of damage to the column.

Once fully repaired, jack 34 may be uniformly lowered wherein the load will be transferred back from column repair jack 10 to the now repaired column. At such time, the column repair jack may be disassembled and reused to repair other damaged columns, or, it can be wheeled to another location for another repair. In particular, pins 64 are removed from openings 68 so that the column bracket can be removed from the repaired column. Subsequently, the extending member can be disassembled, one of the tubes can be attached to positioning stake 54, and the column repair jack is ready for repositioning.

Figure 7:
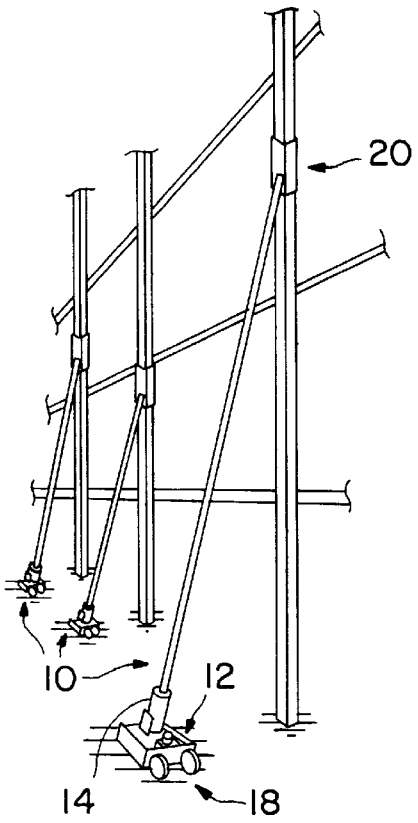
FIG. 7 of the drawings is a perspective view of a shelving system, showing in particular multiple column repair jacks.

As shown in FIG. 7, several of column repair jacks 10 may be used simultaneously. In particular, where several columns are in need of repair, one of the column repair jack can be assembled and attached to each column in need of repair. Subsequently, each one can be repaired, through sleeving or welding, as desired. Once all have been repaired, the column repair jack can be removed. Such use of several column repair jacks facilitates continuous repair without the need to disconnect and reposition and reconnect a single column repair jack.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A column repair jack for repairing a column comprising:

a base positionable on a surface;

a lift member associated with the base;

an extending member having a first end and a second end, the first end being associated with the lift member;

means associated with the second end of the extending member for releasably engaging the column;

means for actuating the lift member, after attachment to the column, wherein the load on the column is at least partially transferred to the column repair jack, to, in turn, facilitate repair of the column;

means for positioning at least a portion of the extending member at predetermined acute angle relative to the column to be repaired, whereupon positioning the second end into engagement, the predetermined acute angle of the positioning means directs the proper placement of the base member at a predetermined distance from the column to be repaired; and means for positioning the base in a desired orientation, the base positioning means comprising:

at least one wheel associated with the base; and means for manipulating the base, to, in turn, transfer at least a portion of the weight of the base to the at least one wheel, the manipulating means comprising a positioning stake associated with the base, wherein the positioning stake cooperates with at least one of the first and second ends of the extending member, wherein the extending member thereby serves as a lever for pivoting the base so as to enable the base to be wheeled about.

2. The column repair jack according to claim 1 wherein the extending member comprises a plurality of releasably attachable tube members, the tube members selectively attachable to render an extending member of a desired length.

3. The column repair jack according to claim 2 wherein the plurality of releasably attachable tube members each comprise a different length.

4. The column repair jack according to claim 1 wherein the base member includes a top surface, and the top surface includes an acute angle relative to the column to be repaired, to, in turn, facilitate positioning of the lift member, and in turn, the extending member at an acute angle.

5. The column repair jack according to claim 1 wherein the base includes a bottom surface comprising a non-skid surface.

6. The column repair jack according to claim 1 wherein the releasable engaging means comprises:

a column bracket configured to matingly engage a column to be repaired; and means for releasably locking the column bracket in mating engagement with the column to be repaired.

7. The column repair jack according to claim 6 wherein the releasable locking means comprises a pin member configured to extend through at least one opening in the column bracket and a corresponding opening in a column to be repaired, to, in turn, maintain the column bracket in mating engagement with the column to be repaired.

8. A column repair jack for repairing a column comprising:

a base positionable on a surface;

a lift member associated with the base;

an extending member having a first end and a second end, the first end being associated with the lift member;

means associated with the second end of the extending member for releasably engaging the column, the releasable engaging means including, a column bracket configured to matingly engage a column to be repaired, the column bracket comprising a center plate and two side plates substantially perpendicular to the center plate, to define a cavity corresponding to the configuration of a column, the at least one opening comprising at least one pair of corresponding openings positioned on opposing side plates, the at least one pair of openings corresponding to at least one pair of openings on the column to be repaired; and means for releasably locking the column bracket in mating engagement with the column to be repaired, wherein the releasable locking means comprises a pin member configured to extend through at least one opening in the column bracket and a corresponding opening in a column to be repaired, to, in turn, maintain the column bracket in mating engagement with the column to be repaired;

means for actuating the lift member, after attachment to the column, wherein the load on the column is at least partially transferred to the column repair jack, to, in turn, facilitate repair of the column; and means for positioning at least a portion of the extending member at predetermined acute angle relative to the column to be repaired, whereupon positioning the second end into engagement, the predetermined acute angle of the positioning means directs the proper placement of the base member at a predetermined distance from the column to be repaired.

9. A column repair jack for repairing a column comprising:

a base positionable on a surface;

a lift member associated with the base;

an extending member having a first end and a second end, the first end being associated with the lift member;

means associated with the second end of the extending member for releasably engaging the column;

means for actuating the lift member, after attachment to the column, wherein the load on the column is at least partially transferred to the column repair jack, to, in turn, facilitate repair of the column;

means for positioning at least a portion of the extending member at an acute angle relative to the column to be repaired;

means for positioning the base in a desired orientation, wherein the positioning means comprises:

at least one wheel associated with the base; and means for manipulating the base, to, in turn, transfer at least a portion of the weight of the base to the at least one wheel, the manipulating means including a positioning stake associated with the base, wherein the positioning stake cooperates with at least one of the first and second ends of the extending member, wherein the extending member thereby serves as a lever for pivoting the base so as to enable the base to be wheeled about.

10. A column repair jack for repairing a column comprising:

a base positionable on a surface;

a lift member associated with the base;

an extending member having a first end and a second end, the first end being associated with the lift member;

means associated with the second end of the extending member for releasably engaging the column, the releasable engaging means including, a column bracket configured to matingly engage a column to be repaired, the column bracket including a center plate and two side plates substantially perpendicular to the center plate, to define a cavity corresponding to the configuration of a column, the at least one opening comprising at least one pair of corresponding openings positioned on opposing side plates, the at least one pair of openings corresponding to at least one pair of openings on the column to be repaired; and means for releasably locking the column bracket in mating engagement with the column to be repaired, the releasable locking means comprising a pin member configured to extend through at least one opening in the column bracket and a corresponding opening in a column to be repaired, to, in turn, maintain the column bracket in mating engagement with the column to be repaired; and means for actuating the lift member, after attachment to the column, wherein the load on the column is at least partially transferred to the column repair jack, to, in turn, facilitate repair of the column.

* * * * *